United States Patent [19]

Murakami et al.

[11] Patent Number: 4,788,703

[45] Date of Patent: Nov. 29, 1988

[54] RADIATION OPTICAL ELEMENT

[75] Inventors: Mutsuaki Murakami, Kawasaki; Susumu Yoshimura, Yokohama, both of Japan

[73] Assignee: Research Development Corporation of Japan, Tokyo, Japan

[21] Appl. No.: 919,117

[22] Filed: Oct. 15, 1986

[30] Foreign Application Priority Data

Oct. 15, 1985 [JP] Japan ..... 60-227889

[51] Int. Cl.[4] ..... G21K 1/06

[52] U.S. Cl. ..... 378/84; 378/85; 250/390

[58] Field of Search ..... 378/84, 85; 427/162; 528/363; 250/390, 505.1

[56] References Cited

U.S. PATENT DOCUMENTS

| | | | |
|---|---|---|---|
| 3,410,834 | 11/1968 | Puckmayer | 528/363 |
| 3,734,893 | 5/1973 | Studinka et al. | 528/363 |
| 4,229,499 | 10/1980 | Jenkins | 378/84 |

*Primary Examiner*—Carolyn E. Fields
*Assistant Examiner*—Joseph A. Hynds
*Attorney, Agent, or Firm*—Armstrong, Nikaido, Marmelstein & Kubovcik

[57] ABSTRACT

Diffraction elements for penetrating radiation, such as X-rays and neutrons, are prepared by coating a film of poly-(phenyleneoxadiazole) onto a substrate and graphitizing the poly-(phenyleneoxadiazole) to form a flexible graphite monocrystal on the substrate.

6 Claims, 2 Drawing Sheets

RADIATION OPTICAL ELEMENT

BACKGROUND OF THE INVENTION

1. Field of the Invention

This invention relates to a graphite-crystal element used as a penetration radiation diffraction element.

2. Description of the Prior Art

It is well known that diffraction elements used for X-ray diffraction instruments such as an X-ray spectroscope, an X-ray microscope, etc. generally involve Bragg diffraction from a crystal. Crystals utilized for that purpose require that the crystal structure be complete, that crystals having the necessary size can be obtained, that the crystal have a absorption coefficient with respect to X-rays, and that the crystals are flexible when used for a crystal spectroscope or the like.

Graphite is one of materials which is desired as an X-ray diffraction element since the absorption coefficient relative to X-rays is low. CAPG (Compression-annealed pyrographite) marketed by Union Carbide Ltd. is obtained by annealing graphite crystal, under pressure, for a long period of time.

In the well known Bragg equation $$2d \sin \theta = \lambda$$

d represents the spacing of a crystal lattice, $\lambda$ the wavelength of reflection X-ray, and $\theta$ the reflection angle. It is said in case of graphite of UNION CARBIDE LTD. that when a monochromatic X-ray, for example, K$\alpha$ line ($\lambda = 1.5418$ Å) of Cu is reflected at the 002 face, the spacing d of the lattice is close to d=3.354 Å, which is the spacing of graphite monocrystal, and the width $\Delta\delta_{002}$ of the reflection line is approximately 0.7°. However, when an attempt is made to obtain such graphite as described above, in the form of a monocrystal of natural graphite, it is impossible to obtain a monocrystal having a large area. If an attempt is made to obtain graphite by hot rolling a hot cracked sedimentary hydrocarbon material, annealing at high temperature for a long period of time under pressure is required, which involves a complicated manufacturing process, and results in high cost products.

In the past, flexed thin silicon monocrystal or graphite were machined to form a sphere. Such processes are cumbersome and costly.

SUMMARY OF THE INVENTION

The present invention provides an artificial graphite which can be produced simply without use of a complicated process such as pressurizing and annealing or the like. There is obtained at low cost a graphite which is completely crystalline and flexible having a large area.

It is known that, when a high polymer is subjected to thermal cracking, it is carbonized while maintaining its original shape. This process is a good process for producing carbonaceous material having a flexibility and a large area. However, the carbonaceous material obtained by this process often has a structure different from that of graphite.

As the result of researches of thermal cracking of various kinds of high polymers, the present inventor has found that a material (hereinafter referred to as GPOD) obtained by processing poly-(para-phenylene-1,3,4-oxadiazole) (hereinafter referred to as POD) on graphitization forms a graphitized film, which is flexible suitable for a diffraction element for penetrating radiation.

The POD starting material for graphitization is a well known, heat-resistant high polymer generally obtained by dewatering and cyclizing a polyhydrazide, which is obtained by the polycondensation of terephthalic acid and hydrazine. It is also possible to obtain POD by reaction of dimethyl terephthalate and hydrazide sulfate, or by the reaction of terephthalic acid chloride and hydrazine, etc. POD is soluble in concentrated sulfuric acid, and the film obtained by casting a concentrated sulfuric acid solution is highly crystalline. This is considered to result from the fact that 1,3,4-oxadiazole having a high polarity, is annuarly oriented by mutual dipole interaction. POD readily forms a nitrogen-contained condensation polycyclic structure in heating at a temperature of 520° to 1400° C., apparently as a result of the orientation of POD. It is assumed that the presence of such a controlled polycyclic structure makes graphitization easy. Accordingly, the highly crystalline isomers of POD are also easily graphitized.

Isomers of POD include poly-(m-phenylene-1,3,4-oxadiazole), poly-(p-phenylene-1,2,4-oxadiazole), poly(m-phenylene-1,2,4-oxadiazole), poly-(o-phenylene-1,3,4-oxadiazole), poly-(o-phenylene-1,2,4-oxadiazole and copolyers thereof, etc.

The graphitization reaction is promoted by pressure or the presence of a catalyst. For example, under a pressure of at 5 Kb, the same effect is obtained at 2200° C. as that obtained by heating at 2800° C. under atmospheric pressure. Also, the graphitization reaction is promoted by heating in the presence of elements in Group IVB to VIIB of the periodic table.

The properties of GPOD obtained by treatment of the aforesaid starting materials at a temperature above 2800° C. at atmospheric pressure are given below:

(1) The diffraction lines with respect to CuK$\alpha$ (1.5418 Å) correspond to faces 002, 004 and 006, as shown in FIG. 1.

(2) The reflection angle ($2\theta$) of the face 002 is 26.576°, and the distance d is 3.354 Å, which coincides with that of graphite monocrystal.

(3) The half-value widths of the reflection line (around $2\theta = 26.576°$) of the face 002 were 2.0° and 0.14° using heat treatment temperatures of 2800° C. and 3000° C., respectively.

(4) The GPOD is flexible and its area may be increased as desired according to the area of the starting material POD and the size of the furnace used for the heat treatment.

BRIEF DESCRIPTION OF THE DRAWINGS

DETAILED DESCRIPTION OF THE PREFERRED EMBODIMENTS (1) X-ray diffraction element FIG. 2 shows an example in which GPOD is coated on the inside of a cylindrical surface to form a converging diffraction element. A CuK alpha-ray is incident upon a diffraction element 1 prepared by coating GPOD having a size of 5 cm×10 cm and a thickness of 30μ onto the base plate, through a hole 1 mm ϕ in an Mo plate 2. The image on a photographic dry plate 3, placed at the focal position forms a single line 1 mm in length and approximately 15 μm in width. Excellent condensation was obtained.

(2) X-ray monochrometer

Figure 1:
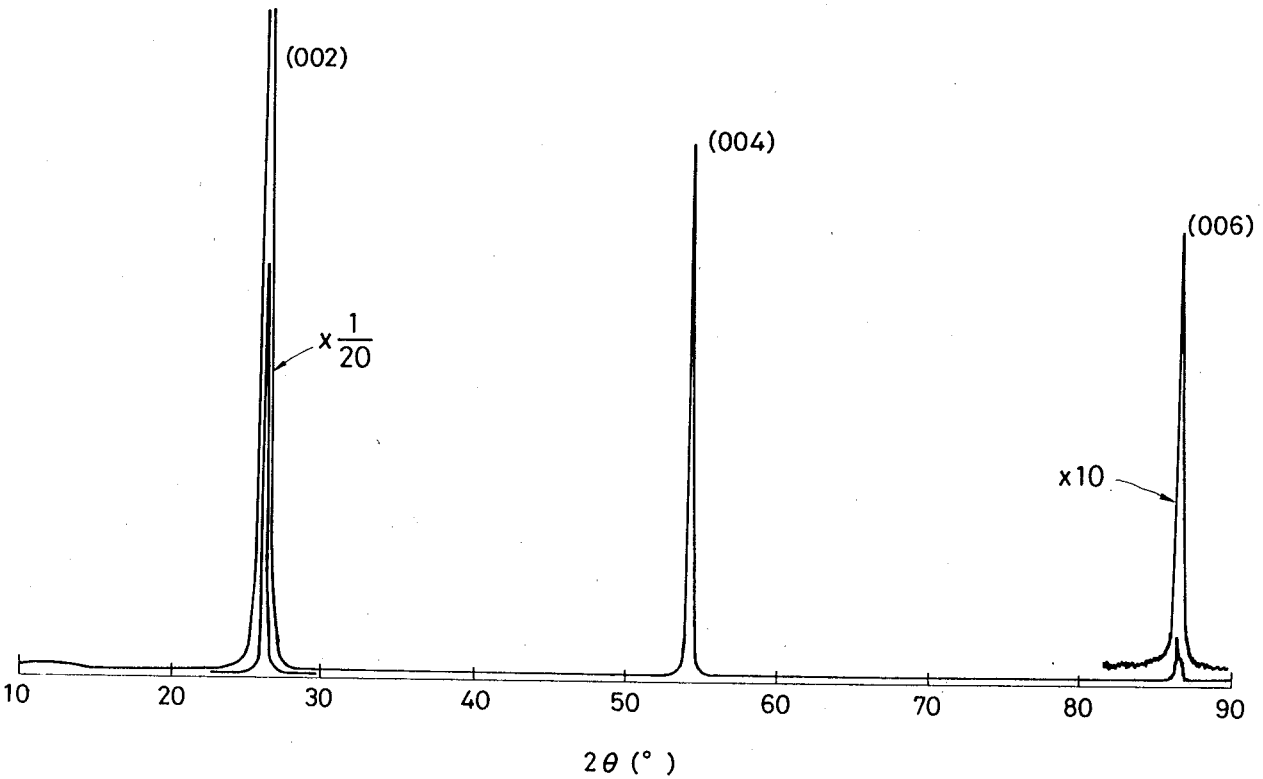
FIG. 1 shows the diffraction spectra of CuK alpha line X-ray radiation from GPOD.
Figure 2:
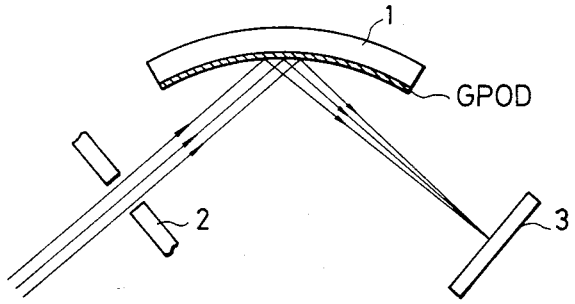
FIG. 2 shows one embodiment of the present invention in which an X-ray diffraction element is employed.
Figure 3:
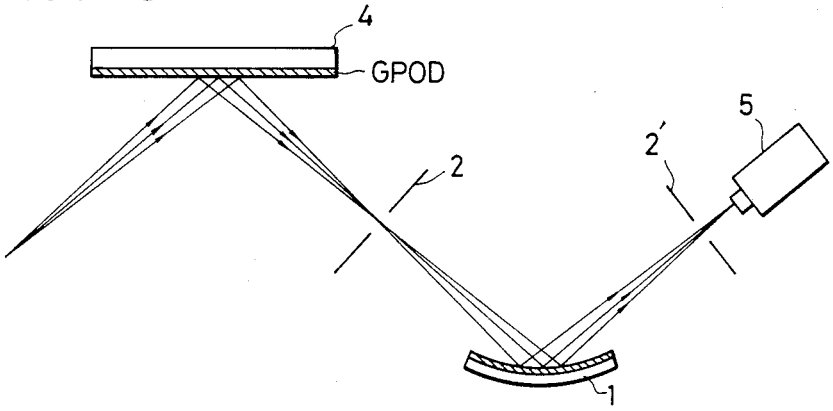
FIG. 3 shows a further embodiment of the invention in which an X-ray monochrometer is employed.

FIG. 3 shows an example in which GPOD is coated onto a flat base plate to form a monochrometer. The monochrometer 4 is prepared by coating GPOD having a size of 5 cm×5 cm and a thickness of 15 μm onto a smooth glass base plate. The wavelength of the X-rays passing through a pin hole in a Mo plate 2 may be varied by varying the angle θ. The X-rays, having passed through the first pin hole 2 pass through a pin hole in a second Mo plate 2' of diffraction element 1 similar to that of Embodiment 1 and is condensed at a counter 5. With X-ray radiation from Cu as the target, the characteristic CuK alpha line was the concentrated at the angle θ=13.288°. When this is compared with the case where a natural graphite monocrystal was used, the line width is decreased from 0.3° to 0.2°, thus confirming the high performance of GPOD.

The embodiments describe a diffraction element for X-ray radiation. However, since the element is made of graphite and is low in neutron absorption, it can be used as monochrometer, etc., for neutrons.

According to the present invention, as described above, it is possible to produce a completely graphitized GPOD at a temperature much lower than that of a conventional CAPG, which is above 2800° C., and obtain an X-ray diffraction element at an extremely low cost. In addition, larger elements and very flexible elements may be obtained as well convenient an for forming X-ray diffraction elements and the like.

What is claimed is:

1. A diffraction element for penetrating radiation comprising a substrate having thereon a flexible graphite monocrystal formed by graphitizing a film of poly-(phenyleneoxadiazole).

2. A diffraction element according to claim 1, wherein the substrate is flat.

3. A diffraction element according to claim 1, wherein the substrate is curved.

4. A monochrometer for X-ray radiation comprising a planar substrate having thereon a flexible graphite monocrystal formed by graphitizing a film of poly-(phenyleneoxadiazole).

5. A diffraction element for converging X-ray radiation comprising a cylindrical substrate having thereon a flexible graphite monocrystal formed by graphitizing a film of poly-(phenyleneoxadiazole).

6. A monochrometer for neutron radiation comprising a planar substrate having thereon a flexible graphite monocrystal formed by graphitizing a film of poly-(phenyleneoxadiazole).

* * * * *